US011851834B2

(12) United States Patent
Hochstetler

(10) Patent No.: US 11,851,834 B2
(45) Date of Patent: Dec. 26, 2023

(54) SNOW STAKE DRIVER AND ASSOCIATED METHOD FOR USING THE SAME

(71) Applicant: Mervin C. Hochstetler, Holland, MI (US)

(72) Inventor: Mervin C. Hochstetler, Holland, MI (US)

( * ) Notice: Subject to any disclaimer, the term of this patent is extended or adjusted under 35 U.S.C. 154(b) by 188 days.

(21) Appl. No.: 17/519,651

(22) Filed: Nov. 5, 2021

(65) Prior Publication Data

US 2023/0146723 A1 May 11, 2023

(51) Int. Cl.
*E04H 17/26* (2006.01)
*E01F 9/70* (2016.01)
*E01F 9/608* (2016.01)

(52) U.S. Cl.
CPC ..... *E01F 9/70* (2016.02); *E04H 17/263* (2013.01); *E01F 9/608* (2016.02)

(58) Field of Classification Search
CPC ..... E04H 17/26; E04H 17/261
USPC ..... 173/90, 91
See application file for complete search history.

(56) References Cited

U.S. PATENT DOCUMENTS

D56,118 S 8/1920 Chance
2,998,087 A * 8/1961 Iddings ..... E02D 7/04 173/133
3,712,389 A * 1/1973 Smoak ..... B25D 1/00 173/90
3,735,822 A * 5/1973 Deike ..... B25D 1/16 144/195.5
3,747,690 A * 7/1973 Deike ..... E02D 3/046 173/121
4,101,088 A * 7/1978 Stauth ..... E04H 17/263 242/406
4,280,540 A * 7/1981 Meacham ..... B27L 7/005 144/195.5
4,291,495 A 9/1981 Crippen
D267,876 S 2/1983 Malmin
4,483,058 A 11/1984 Clutter et al.
4,589,500 A 5/1986 Moraly
D284,930 S 8/1986 Richards
4,620,506 A 11/1986 Stubbs
4,703,549 A * 11/1987 Grandt ..... B25D 1/16 173/91
5,020,605 A 6/1991 Leishman
5,029,427 A * 7/1991 Jewett ..... E04H 17/263 52/741.11
5,337,836 A * 8/1994 Williams ..... E02D 7/04 173/90
D356,475 S 3/1995 Boylan
(Continued)

OTHER PUBLICATIONS

Independently—Definition by Merriam-Webster, retrieved from URL https://www.merriam-webster.com/dictionary/independently%20of (Year: 2023).*

*Primary Examiner* — Valentin Neacsu
(74) *Attorney, Agent, or Firm* — King & Partners, PLC

(57) ABSTRACT

A snow stake driver that allows for fast, safe, and convenient placement of snow stakes at controlled and/or predetermined depths in soil with aggregate and/or rocks, including: a body, wherein the body is elongated and includes a first end and a second end; a handle member, wherein the handle member is positioned proximate to the first end of the body; a depth setting plate, wherein the depth setting plate is positioned proximate to the second end of the body; and a ground-engaging drive rod.

1 Claim, 8 Drawing Sheets

(56) References Cited

U.S. PATENT DOCUMENTS

D363,199 S 10/1995 Domagala
5,538,302 A 7/1996 Travis
5,768,785 A * 6/1998 Pessin ..... E04D 15/003 173/90
5,934,139 A * 8/1999 Tucker ..... B25B 5/08 173/90
5,996,705 A * 12/1999 Downs ..... E02F 5/10 173/91
D428,389 S 7/2000 Love
6,347,672 B1 2/2002 Reardon
6,364,031 B1 * 4/2002 Amicangelo ..... E02D 7/04 173/90
6,968,989 B1 * 11/2005 Hall, Jr. ..... B25C 1/02 173/90
7,089,694 B2 * 8/2006 Allen ..... G09F 15/0037 40/607.04
7,121,357 B1 * 10/2006 Raimondi ..... B25D 17/02 173/90
D555,682 S 11/2007 Foster
7,303,027 B1 12/2007 Laemmer
8,096,368 B1 * 1/2012 Rider ..... E04H 17/263 173/90
10,774,560 B1 9/2020 McCugh
2004/0154812 A1 8/2004 McDonald
2006/0241647 A1 * 10/2006 Chen ..... E04H 17/263 606/100
2008/0257113 A1 * 10/2008 Neumarkel ..... B25D 1/16 81/27
2009/0090527 A1 * 4/2009 Wilson ..... E04H 17/263 173/90
2011/0198104 A1 8/2011 Stockstill
2011/0259621 A1 * 10/2011 Oberg ..... A01G 3/08 173/133
2017/0043468 A1 * 2/2017 Wade ..... B25F 1/006
2023/0146723 A1 * 5/2023 Hochstetler ..... E01F 9/70 173/90

* cited by examiner

SNOW STAKE DRIVER AND ASSOCIATED METHOD FOR USING THE SAME

CROSS-REFERENCE TO RELATED APPLICATIONS

This application is related to U.S. Design patent application Ser. No. 29/814,373, entitled "Snow Stake Driver," filed Nov. 5, 2021—which is hereby incorporated herein by reference in its entirety, including all references cited therein.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to impact tools, and, more particularly, to snow stake drivers that allow for fast, safe, and convenient placement of snow stakes at controlled and/or predetermined depths—even in soil with aggregate and/or rocks, including, for example, areas proximate to roads and/or the end of driveways. The snow stake drivers of the present invention are suitable with, for example, residential, commercial, and/or industrial snow stakes.

2. Background Art

Impact tools and drivers have been known in the art for years and are the subject of a plurality of patents and publications, including: U.S. Pat. No. 10,774,560 entitled "Driveable Stake Member," U.S. Pat. No. 5,934,139 entitled "Bi-Directional Impact Tool," U.S. Pat. No. 5,538,302 entitled "Article Handling Tool," U.S. Pat. No. 4,483,058 entitled "Impact Hammer Elbow Tool," U.S. Pat. No. 4,101,088 entitled "Manual Impact Stake Driving Apparatus," U.S. Pat. No. 3,747,690 entitled "Jack Hammer," U.S. Pat. No. 3,712,389 entitled "Post Driver," United States Patent Application Publication Number 2011/0198104 entitled "Stake Driver," United States Patent Application Publication Number 2008/0257113 entitled "Stake Driver," and United States Patent Application Publication Number 2004/0154812 entitled "Stake Driver Hand Tool"—all of which are hereby incorporated herein by reference in their entirety including all references cited therein.

U.S. Pat. No. 10,774,560 appears to disclose a drivable stake for attachment to an article that includes an elongated stake having a first end section that terminates at a first end and a second end section that terminates at an opposing second end. The elongated stake has impact drive shoulders and a stake plate that is coupled to the elongated stake and in contact with the impact drive shoulders. A coupling member surrounds the elongated stake and includes an opening for attachment to the article. A hollow impact drive member slidingly travels along the second end section of the elongated stake for striking the stake plate and driving the first end section into the ground. The stake includes a fastener for coupling the impact drive member to the elongated stake during a driving action and for locking the impact drive member in place relative to the elongated stake in a locked position.

U.S. Pat. No. 5,934,139 appears to disclose a bi-directional impact tool that includes a hollow tube member and a shaft slidably received by the hollow tube member in a telescopic relationship. The hollow tube member extends along a longitudinal axis and has a first end and a second end disposed opposite the first end. The shaft extends longitudinally along the longitudinal axis and has a working end disposed exteriorly of the hollow tube member for engaging the workpiece and a striking end disposed opposite the working end and interiorly of the hollow tube member. Moving the hollow tube member in a first direction so that the first end collides with the striking end while the working end is engaged with the workpiece imparts a first impact force to the workpiece in the first direction. Moving the hollow tube member in a second direction opposite the first direction so that the second end collides with the striking end while the working end is engaged with the workpiece imparts a second impact force to the workpiece in the second direction.

U.S. Pat. No. 5,538,302 appears to disclose an article handling tool for pushing, pulling and manipulating articles on the bed of a covered or capped pick-up truck and is defined by an elongated pole having a hand grip at one end and a push-pull blade at an opposite end. The opposite end also includes a retractable loop which can be housed within the pole in an unobtrusive inoperative position yet can be readily withdrawn from a chamber of the elongated pole and utilized to encircle or lasso an article. In this manner the loop end and/or the blade allows the article handling tool to be utilized by an individual to manipulate articles of any shape or size seated upon the bed of a covered pick-up truck without the effort and hazard involved heretofore as individuals necessarily climbed into and moved about in the cramped cargo area of such covered pick-up trucks.

U.S. Pat. No. 4,483,058 appears to disclose a simplified, impulse-type pulling and installing tool for appliances such as electrical connector elbows which in use generate a sharp impact force to facilitate quick, safe elbow manipulation even under electrical load, thereby reducing the probability of flashover. In preferred forms, the tool includes an elongated rod having workpiece-engaging apparatus adjacent one end thereof, with tubular hammer means telescoped over the rod and reciprocably slidable along a portion of the length thereof. The hammer includes structure defining a pair of hammering surfaces respectively located adjacent the opposed ends of the hammer, and the rod is moreover provided with anvil means secured thereto and oriented for engagement by the hammering surfaces when the hammer is slid along the rod. A pair of such hammering surfaces are provided, which are cooperatively oriented relative to the hammering means, so that fore and aft impact forces can be developed along the length of the rod as desired. In particularly preferred forms, the anvil means is secured to the rod within the bore of the hammer means, and presents a pair of opposed anvil surfaces respectively engageable by corresponding, internal hammering surfaces on the hammering means.

U.S. Pat. No. 4,101,088 appears to disclose an improved manual impact apparatus for driving a stake of the type having a head at one end thereof, which is characterized by a slidable sleeve having oppositely disposed and facing impact stops therein to confine the stake head therebetween during driving or pulling, whereby the stake may be longitudinally propelled in response to impact between one of the impact stops and the stake head.

U.S. Pat. No. 3,747,690 appears to disclose an improved manually actuated self-energizing jack hammer or driver useful as a demolition tool, a compactor, a post or pile driver, a digging tool and the like, composed of an inner anvil tube or barrel receiving a post or pile therein or mounting a tamper, a breaker, a cutter, a digger or the like tools and a tubular ram or hammer telescoped over and guided on the barrel with a recoil spring between the anvil and hammer for lifting the ram after it delivers a hammer blow to the anvil barrel. The inner tube or anvil barrel separates and insulates the driver member such as a fence post or tool from contact with the hammer ram and at the same time guides the ram to insure maximum direct delivery of force from the ram to the tool or post. Handles are provided on the ram for convenient grasping by a single operator to impart a rhythmic reciprocation to the ram aided by the recoil spring to deliver maximum impact blows through the anvil barrel to the tool or post with minimum manual effort. The telescoped barrel tube and ram tube are preferably non-circular in cross-section to prevent relative rotation of the tubes and a heavy hard steel hammer head is secured in the open top of the ram tube preferably in non-mating relation to provide an air vent. The guide tube or barrel also preferably has a heavy hard steel head on the top end thereof providing an anvil receiving the blows from the hammer head. A lock bolt is provided to selectively hold the tubes in telescoped relation.

U.S. Pat. No. 3,712,389 appears to disclose a tubular post driving member that telescopes over the post and has an upper end plate to deliver impact to the top of the post. The driving member has sets of handle sockets at different elevations and these sockets receive removable handles in either 180 degree or 90 degree spacing circumferentially of the post to permit driving of the post in different situations by two workers or one worker. Additional hand grips are provided for erecting the post and driver and for transporting. An adjustable depth gage may also be included on the driver.

United States Patent Application Publication Number 2011/0198104 appears to disclose a stake driver for driving wood stakes into a soil that has a rectangular hollow housing having an open top and an open bottom. The bottom portion is configured for receiving at least a part of the wood stake therein, while an elongated driving shaft extends from an interior of the housing upwardly above a top edge of the housing. The upper part of the driving shaft is configured for engagement by a power transmitting tool, such as for instance a jack hammer. A driving pad is secured to a bottom end of the driving shaft transversely to the longitudinal axis of the housing. At least one hammer plate is secured, through connection to a shaft sleeve, to the driving shaft above the driving pad. The hammer plate and the driving pad are each configured to move in an axial direction inside the housing and transmit a hammering force to the wood stake. The hammering force is partially absorbed by a compression spring positioned between the hammer plate and the driving pad.

United States Patent Application Publication Number 2008/0257113 appears to disclose a manually operated stake driver that has a slide hammer and guide. The guide is fitted with a receiver that captures and guides the stake. The slide hammer provides percussion force directly to the stake by extending into the receiver when the slide hammer is actuated. The slide hammer may have a weight attached or incorporated into a handle to provide additional force to the stake when actuated. In one embodiment, the stake driver may be designed to be used while the operator is standing and to drive stakes into the ground.

United States Patent Application Publication Number 2004/0154812 appears to disclose a stake and post driver having a sleeved construction topped with an expanded impact head. The stake driver body is provided with a concavity for receiving an exposed end of the stake or post to be driven. The concavity is sized and shaped to receive the exposed end of the stake along a length sufficient to grip and support the stake or post during the entirety of the driving operation. The impact head is sized and configured to provide an enhanced "sweet spot" targeted by the user, thereby reducing the requirement for essentially total accuracy in exactly delivering a significant driving impact from a manual driver such as a sledge hammer, mallet or other hand-held mechanical driving means to the typically small target of the exposed end of the stake or post to be driven. One or more spacers are provided to be removably installed in the stake driver, the spacer having a receiving recess for supporting a stake against substantial lateral motion during driving installation of a stake or post.

While the above-identified patents and publications do appear to disclose various impact tools and drivers, their configurations remain non-desirous and/or problematic inasmuch as, among other things, none of the above-identified drivers appear to facilitate fast, safe, and convenient placement of snow stakes at controlled and/or predetermined depths—even in soil with aggregate and/or rocks, including, for example, areas proximate to roads and/or the end of driveways.

These and other objects of the present invention will become apparent in light of the present specification, claims, and drawings.

SUMMARY OF THE INVENTION

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The present invention is directed to a snow stake driver that allows for fast, safe, and convenient placement of snow stakes at controlled and/or predetermined depths in soil with aggregate and/or rocks, comprising, consisting essentially of and/or consisting of: (a) a body, wherein the body is elongated and comprises a first end and a second end; (b) a handle member, wherein the handle member is positioned proximate to the first end of the body; (c) a depth setting plate, wherein the depth setting plate is positioned proximate to the second end of the body; and (d) a ground-engaging drive rod.

In a preferred embodiment of the present invention, the body of the snow stake driver includes an outer wall, an inner wall, an inner top surface, and an aperture.

In another preferred embodiment of the present invention, the inner wall of the body includes a ground-engaging drive rod stop member that serves to limit lower displacement of the ground-engaging drive rod.

In yet another preferred embodiment of the present invention, the handle member forms a T-handle with the body. In this embodiment, the handle member is adapted to be gripped by two hands of a user.

In one preferred embodiment of the present invention, the handle member is secured to or forms part of the first end of the body.

In a preferred embodiment of the present invention, the handle member comprises a weighted member or sub-assembly that is positioned above the body of the snow stake driver to facilitate impacting the ground-engaging drive rod in a downward and forceful manner.

In another preferred embodiment of the present invention, the depth setting plate comprises a disc positioned at the bottom of the second end of the body of the snow stake.

In yet another preferred embodiment of the present invention, the ground-engaging drive rod comprises a first end and a second end. In this embodiment, the first end of the ground-engaging drive rod preferably comprises a head that contacts the inner top surface of the body while in a retracted position, and contacts the ground-engaging drive rod stop member while in a fully extended position.

In one preferred embodiment of the present invention, the second end of the ground-engaging drive rod comprises a tip that is adapted to break up aggregate and/or rocks.

In a preferred embodiment of the present invention, the body, the handle member, the depth setting plate, and the ground-engaging drive rod are independently fabricated from a material selected from the group consisting of a metal, a natural resin, a synthetic resin, a plastic, a composite, and/or wood.

The present invention is also directed to a snow stake driver that allows for fast, safe, and convenient placement of snow stakes at controlled and/or predetermined depths in soil with aggregate and/or rocks, comprising, consisting essentially of and/or consisting of: (a) a body, wherein the body is elongated and comprises a first end, a second end, an inner top surface, and a ground-engaging drive rod stop member; (b) a handle member, wherein the handle member is positioned proximate to the first end of the body; (c) a depth setting plate, wherein the depth setting plate is positioned proximate to the second end of the body; (d) a ground-engaging drive rod, wherein the ground-engaging drive rod include a head and is at least partially positioned in the body of the snow stake driver; (e) wherein the snow stake driver is infinitely displaceable between a retracted position and an extended position; (f) wherein when in the retracted position, the head of the ground-engaging drive rod contacts the inner top surface of the body; and (g) wherein when in the extended position, the head of the ground-engaging drive rod contacts the ground-engaging drive rod stop member of the body.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted.

It will be further understood that the invention is not necessarily limited to the particular embodiments illustrated herein.

Figure 1:
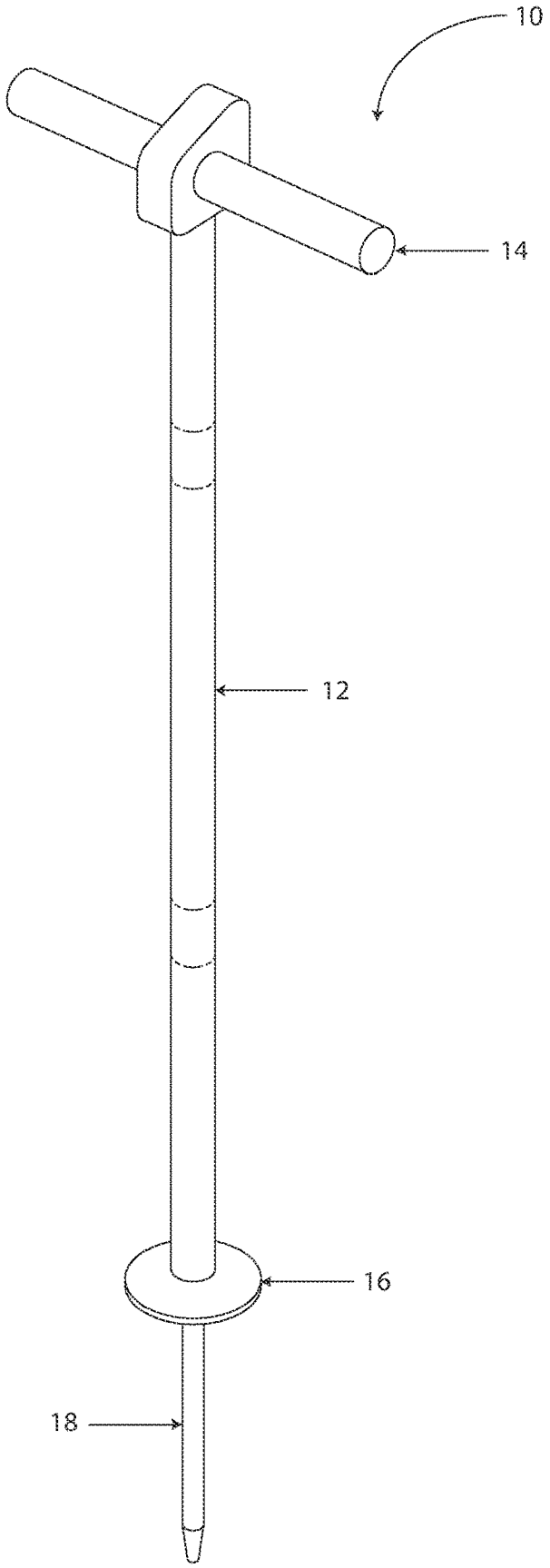
Figure 2:
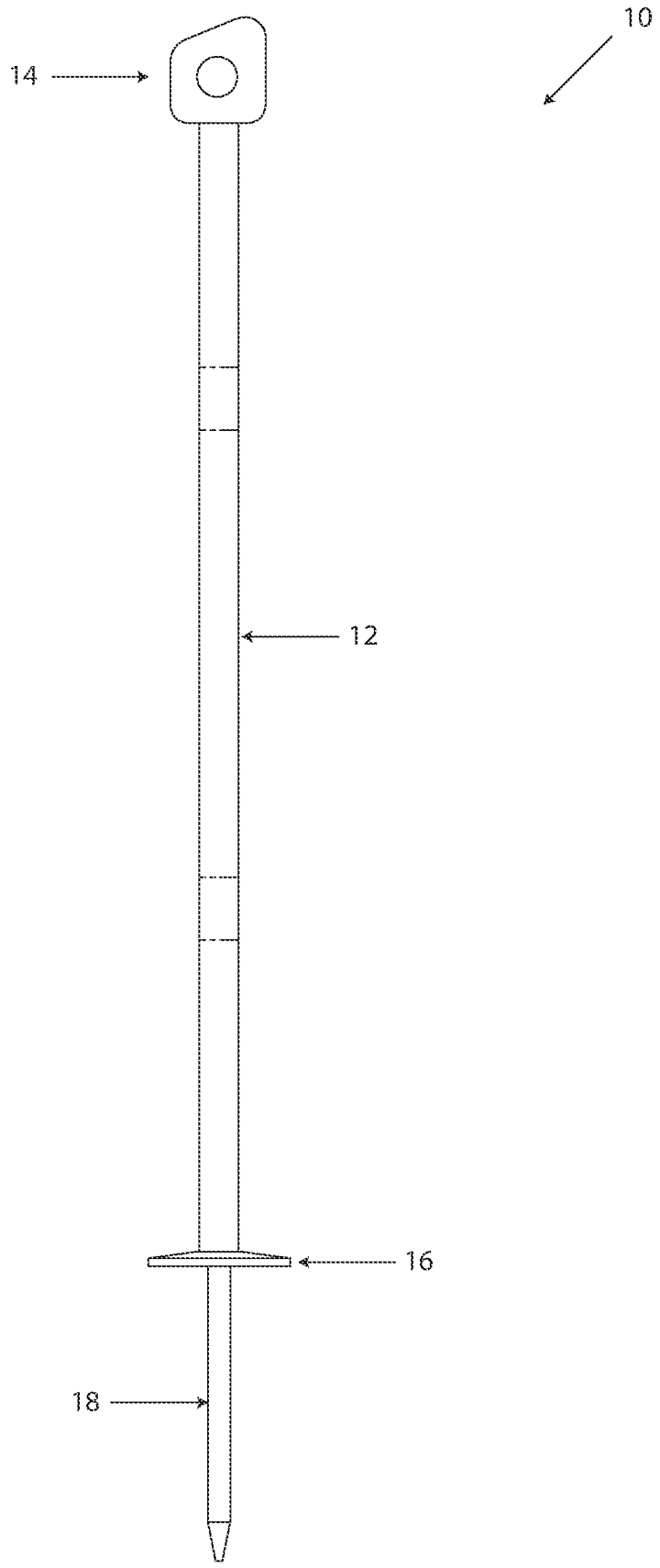
Figure 3:
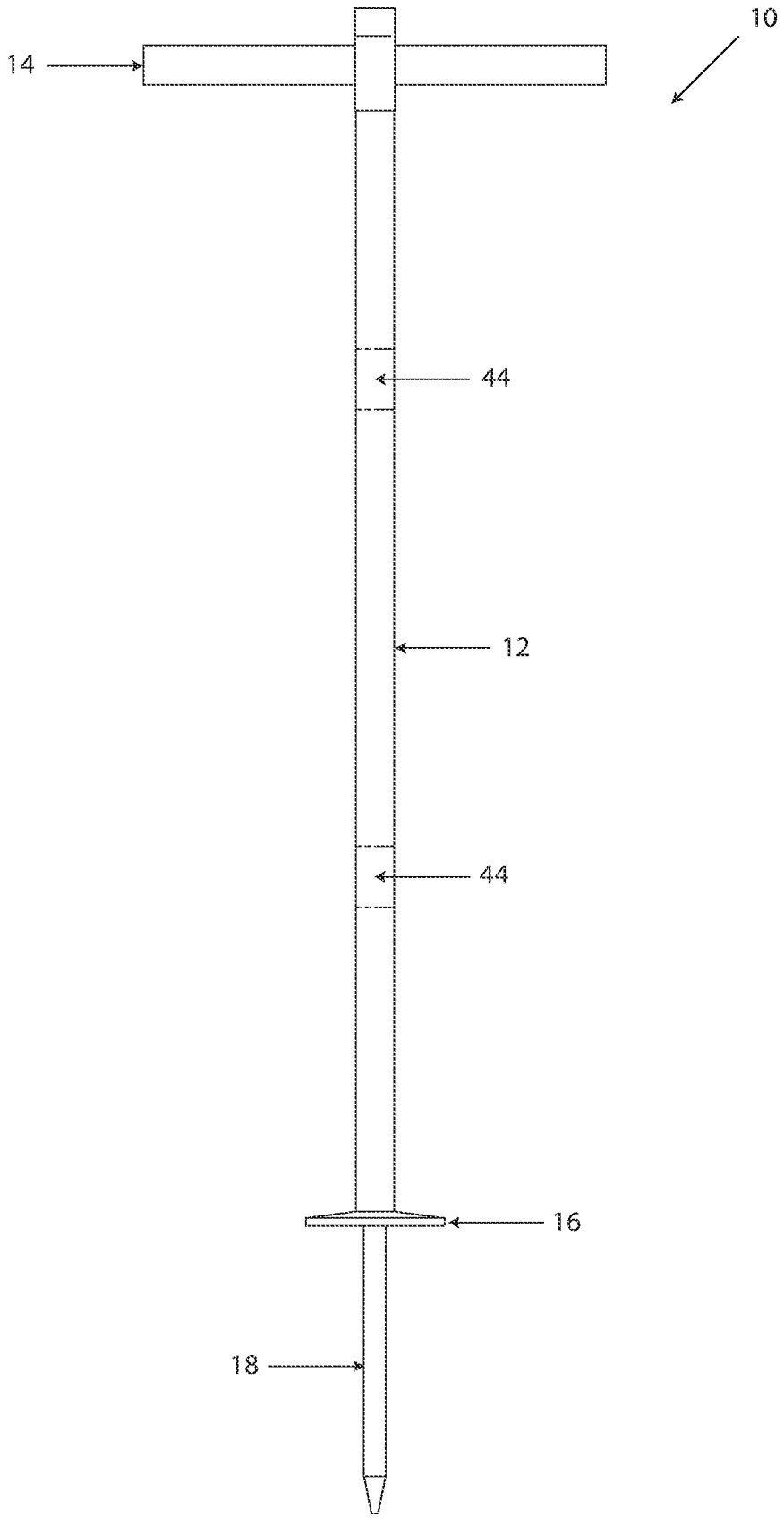
Figure 4:
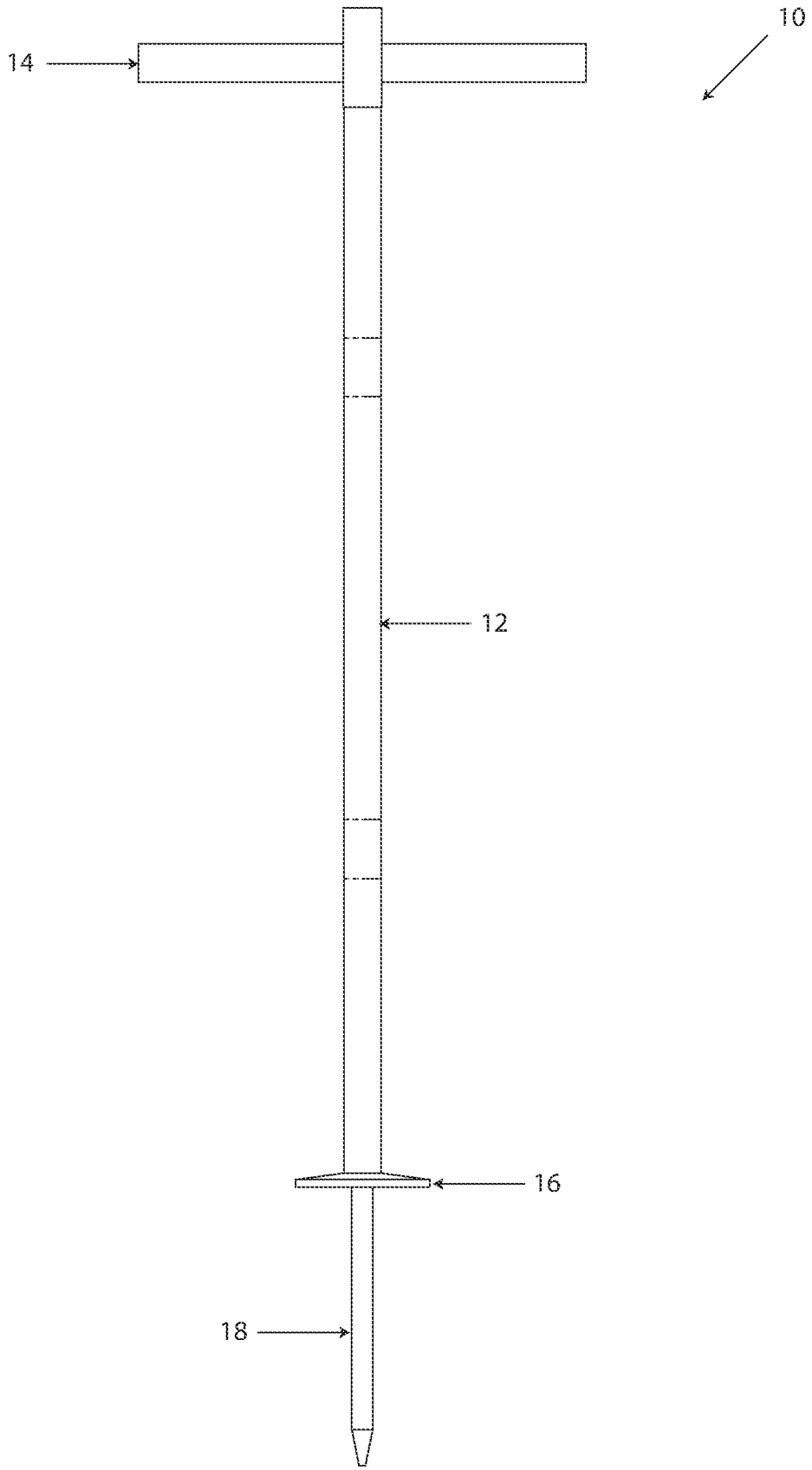
Figure 5:
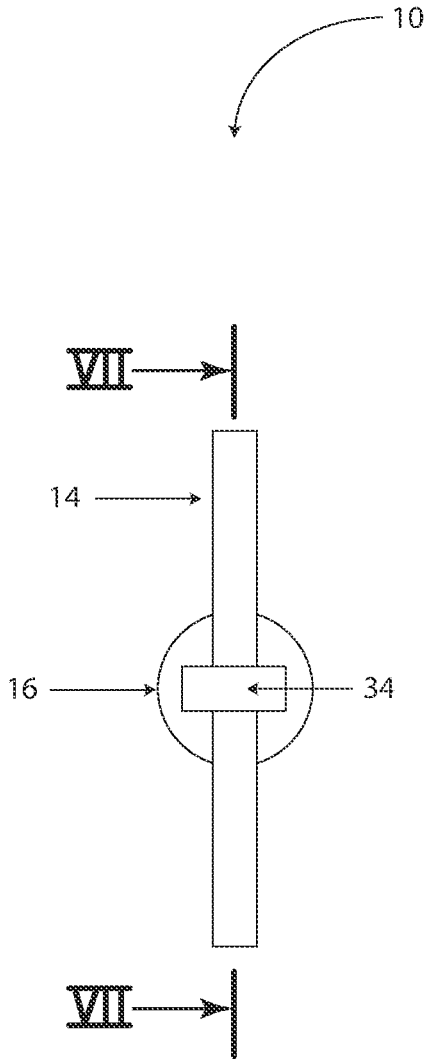
Figure 6:
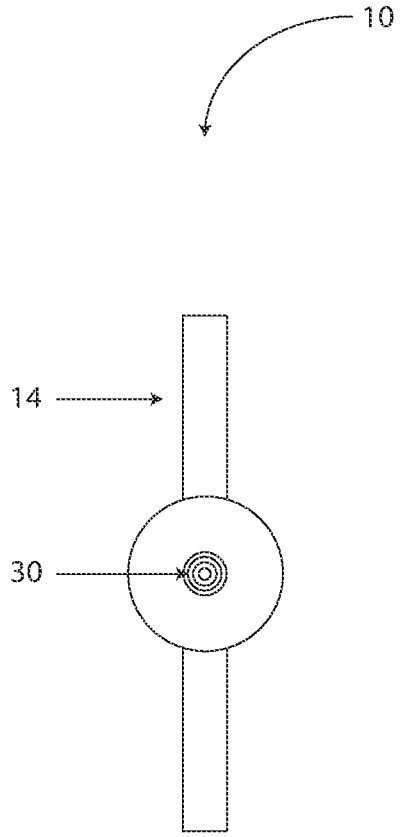
Figure 7:
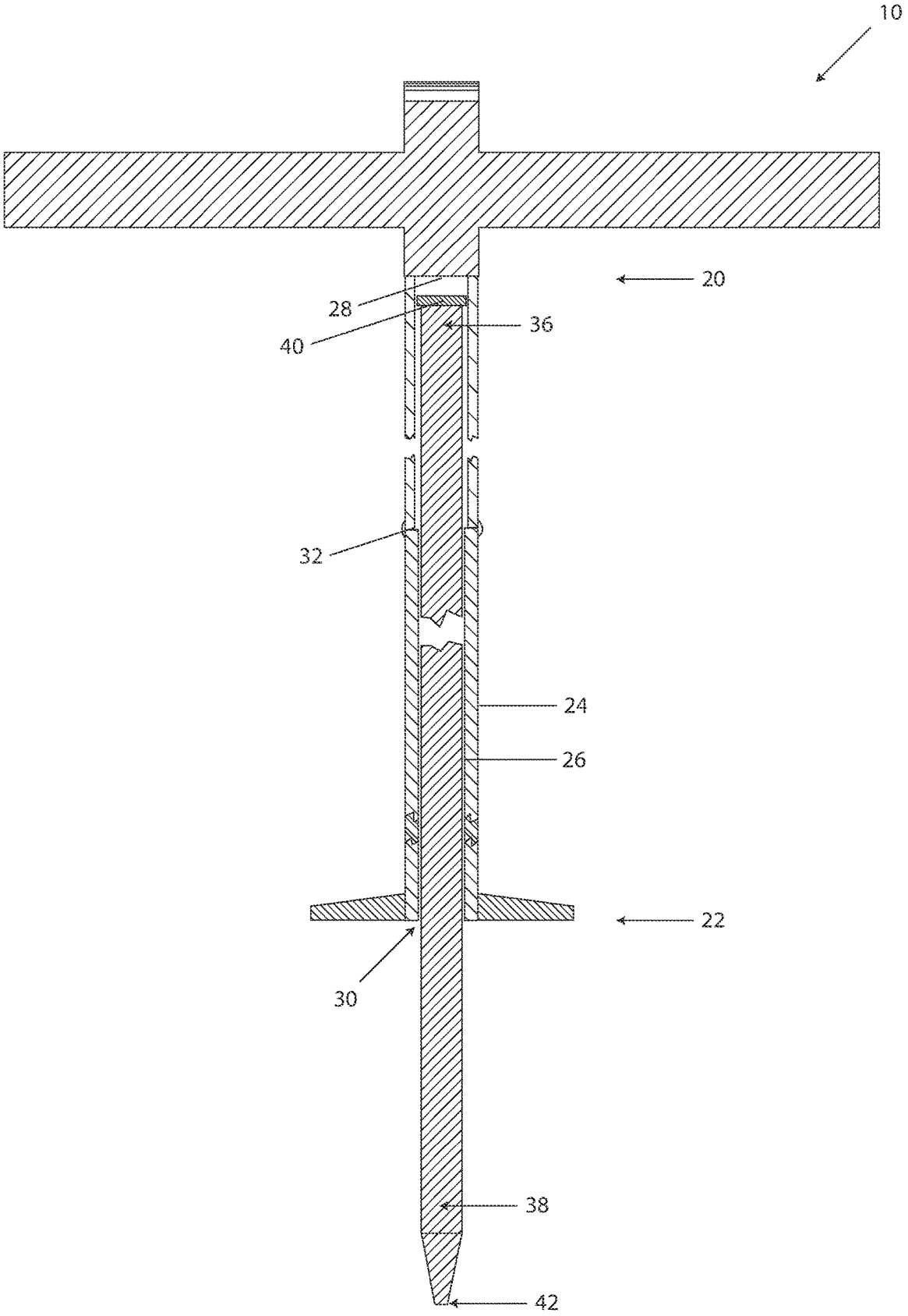
Figure 8A:
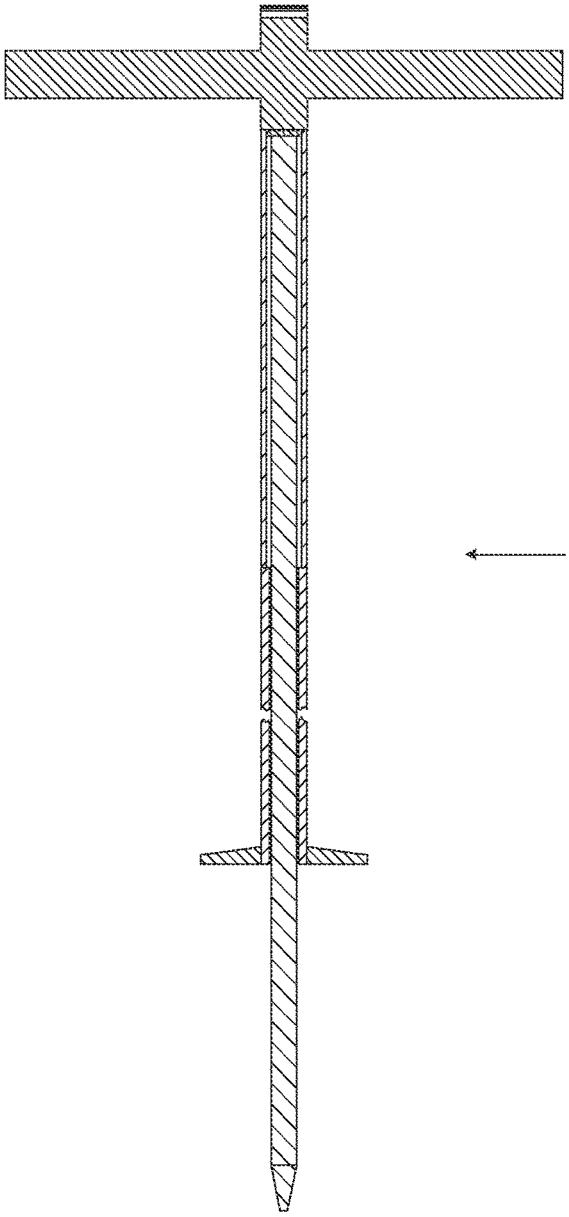
Figure 8B:
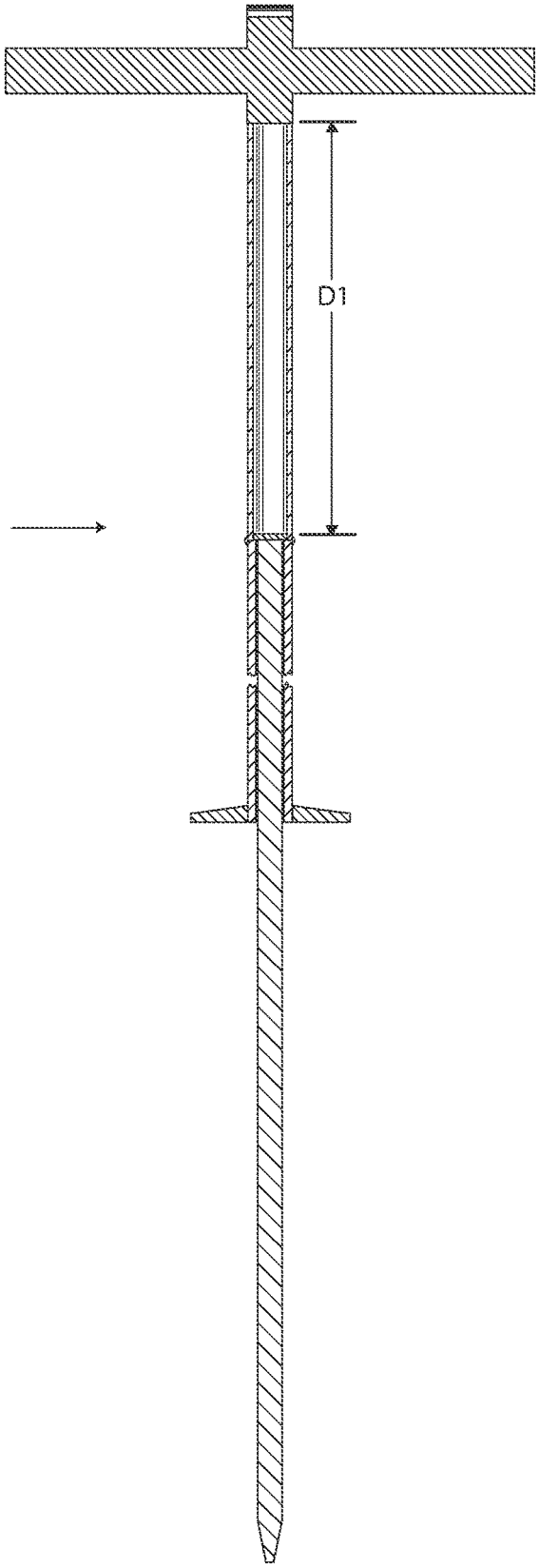

The invention will now be described with reference to the drawings wherein:

FIG. 1 of the drawings is a perspective view of a snow stake driver in accordance with the present invention;

FIG. 2 of the drawings is a side view of the snow stake driver of FIG. 1;

FIG. 3 of the drawings is a front view of the snow stake driver of FIG. 1;

FIG. 4 of the drawings is a rear view of the snow stake driver of FIG. 1;

FIG. 5 of the drawings is a top view of the snow stake driver of FIG. 1;

FIG. 6 of the drawings is a bottom view of the snow stake driver of FIG. 1;

FIG. 7 of the drawings is a cross-sectional view of the snow stake driver taken along line VII of FIG. 5;

FIG. 8A of the drawings is a cross-sectional view of a snow stake driver of the present invention shown in a first position (i.e., retracted); and FIG. 8B of the drawings is a cross-sectional view of a snow stake driver of the present invention shown in a second position (i.e., extended).

DETAILED DESCRIPTION OF THE INVENTION

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

Referring now to the drawings, and to FIGS. 1-7 in particular, snow stake driver 10 is shown as generally comprising body 12, handle member 14, depth setting plate 16, and ground engaging drive rod 18. In accordance with the present invention, snow stake driver 10 allows for the fast, safe, and convenient placement of snow stakes at controlled and/or predetermined depths in soil with aggregate and/or rocks.

As is best shown in FIG. 7, body 12 is elongated and includes first or upper end 20, second or lower end 22, outer wall 24, inner wall 26, inner top surface 28, and aperture 30. It will be understood that inner top surface 28 serves to limit upper displacement of ground-engaging drive rod 18 (See FIG. 8A), and the inner wall of the body includes ground-engaging drive rod stop member 32 that serves to limit lower displacement of ground-engaging drive rod 18 (See FIG. 8B).

Handle member 14 is positioned proximate to first end 20 of body 12. Preferably, handle member 14 is secured to or forms part of first end 20 of body 12 in a T-handle configuration. Such a configuration enables a user to grip and drive the apparatus with two hands.

Preferably, handle member 14 includes a weighted sub-assembly or component 34 that is positioned above the body of the snow stake driver.

Depth setting plate 16 of snow stake driver 10 is positioned proximate to the second or lower end of the body. Preferably, depth setting plate 16 includes a disc positioned at the bottom of the second end of the body. It will be understood that, during normal use, depth setting plate 16, engages the ground and thus limits the depth which drive rod 18 can be driven.

Ground-engaging drive rod 18 includes first or upper end 36 and second or lower end 38. The first end of ground-engaging drive rod 18 includes head 40 that contacts inner top surface 28 of the body while in a retracted position, and contacts ground-engaging drive rod stop member 32 while in a fully extended position. The second or lower end of the ground-engaging drive rod preferably includes pointed tip 42 that is adapted to break up aggregate and/or rocks—especially proximate to roads and/or the end of driveways.

In accordance with the present invention, the body, the handle member, the depth setting plate, and the ground-engaging drive rod are independently fabricated from metals (e.g. aluminum, tin, copper, nickel, titanium, steel, and alloys thereof), natural resins, synthetic resins, plastics, composites, woods, and mixtures thereof.

As is best shown in FIG. 3, body 12 preferably includes one or more reflective members and/or tape 44, which protects an installer from vehicles during dusk and/or dawn times of stake installation.

In operation, a user manually displaces snow stake driver 10 between positions shown in FIG. 8A and FIG. 8B. This breaks up and/or displaces aggregate and rocks until the depth setter contacts the surface or ground. The user can then place a snow stake in the ground at the predetermined depth. This operation is repeated until all desired snow stakes have been placed for the season.

The foregoing description merely explains and illustrates the invention and the invention is not limited thereto except insofar as the appended claims are so limited, as those skilled in the art who have the disclosure before them will be able to make modifications without departing from the scope of the invention.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etcetera shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etcetera. As a non-limiting example, each range discussed herein can be readily broken down into a lower third, middle third and upper third, etcetera. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed and desired to be secured by Letters Patent of the United States is:

1. A snow stake driver, comprising:

a body, wherein the body is elongated and comprises a first end, a second end, a body length between the first end and the second end, an outer wall, an inner wall, an inner top surface, and an aperture, and wherein the body includes at least one reflective member positioned thereon and a ground-engaging drive rod stop member on the inner wall;

a handle member, wherein the handle member is positioned proximate to the first end of the body, wherein the handle member forms a T-handle with the body, wherein the T-handle is adapted to enable a user to grip and drive the snow stake driver with two hands; wherein the handle member comprises a first cylindrical rod and a second cylindrical rod, each rod having a top surface, a bottom surface, an outer end, an inner end, a length extending between respective outer and inner ends orthogonally to the body length, and a height emanating orthogonal to the respective length, wherein the length of the first cylindrical rod is greater than the height of the first cylindrical rod, wherein the length of the second cylindrical rod is greater than the height of the second cylindrical rod, wherein a weighted component having a top surface is positioned between the first and second cylindrical rods, wherein the top surface of the weighted component is positioned above the top surfaces of the first and second cylindrical rods, a depth setting plate, wherein the depth setting plate comprises a disc having a diameter, a conical top surface and a planar bottom surface, wherein the depth setting plate is positioned proximate to the second end of the body, wherein the ground-engaging drive rod stop member of the body is positioned above the top surface of the depth setting plate, and wherein the diameter of the depth setting plate is less than the length of each of the first and second cylindrical rods of the handle member;

a ground-engaging drive rod, wherein the ground-engaging drive rod includes a head and is at least partially positioned in the body of the snow stake driver;

wherein the snow stake driver is displaceable between a retracted position and an extended position;

wherein when in the retracted position, the head of the ground-engaging drive rod contacts the inner top surface of the body; and wherein when in the extended position, the head of the ground-engaging drive rod contacts the ground-engaging drive rod stop member of the body.

* * * * *